US009235187B2

(12) United States Patent
Nishikawa

(10) Patent No.: US 9,235,187 B2
(45) Date of Patent: Jan. 12, 2016

(54) REMOVAL DEVICE AND IMAGE FORMING APPARATUS

(71) Applicant: FUJI XEROX CO., LTD., Tokyo (JP)

(72) Inventor: Hiroshi Nishikawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/612,974

(22) Filed: Feb. 3, 2015

(65) Prior Publication Data

US 2015/0268621 A1 Sep. 24, 2015

(30) Foreign Application Priority Data

Mar. 20, 2014 (JP) ..... 2014-058051

(51) Int. Cl.
*G03G 21/10* (2006.01)
*G03G 15/16* (2006.01)
*G03G 21/16* (2006.01)

(52) U.S. Cl.
CPC ..... *G03G 21/16* (2013.01); *G03G 15/166* (2013.01); *G03G 21/10* (2013.01); *G03G 2215/1661* (2013.01); *G03G 2221/0005* (2013.01)

(58) Field of Classification Search
CPC ..... G03G 15/166; G03G 21/0005; G03G 21/0011; G03G 21/10; G03G 21/16; G03G 2215/1647; G03G 2215/1652; G03G 2215/1657; G03G 2215/1661; G03G 2221/0005
USPC ..... 399/102, 103, 105, 101, 350
See application file for complete search history.

(56) References Cited

U.S. PATENT DOCUMENTS 8,229,317 B2 * 7/2012 Xu et al. ..... 399/105
2013/0084098 A1 * 4/2013 Kanazawa et al. ..... 399/103

FOREIGN PATENT DOCUMENTS

JP 2001-109344 A 4/2001

* cited by examiner

*Primary Examiner* — Sophia S Chen
(74) *Attorney, Agent, or Firm* — Oliff PLC

(57) ABSTRACT

A removal device includes a scraping member extending in a crossing direction that crosses a movement direction in which a cleaning object moves, the scraping member scraping waste off a surface of the cleaning object at a contact portion of the scraping member that is in contact with the surface; and a pair of sealing members disposed on both outer sides of the scraping member in the crossing direction and sealing the both outer sides by contacting the surface. Each of the sealing members includes a protruding portion that protrudes beyond the contact portion upstream in the movement direction of the cleaning object. The protruding portion has a slit that extends diagonally from an edge of the protruding portion outward in the crossing direction and upstream in the movement direction, the edge facing inward in the crossing direction.

3 Claims, 8 Drawing Sheets

REMOVAL DEVICE AND IMAGE FORMING APPARATUS

CROSS-REFERENCE TO RELATED APPLICATIONS

This application is based on and claims priority under 35 USC 119 from Japanese Patent Application No. 2014-058051 filed Mar. 20, 2014.

BACKGROUND

1. Technical Field

The present invention relates a removal device and an image forming apparatus.

2. Summary

According to an aspect of the present invention, a removal device includes a scraping member extending in a crossing direction that crosses a movement direction in which a cleaning object moves, the scraping member scraping waste off a surface of the cleaning object at a contact portion of the scraping member that is in contact with the surface; and a pair of sealing members disposed on both outer sides of the scraping member in the crossing direction and sealing the both outer sides by contacting the surface, each of the sealing members including a protruding portion that protrudes beyond the contact portion upstream in the movement direction of the cleaning object, the protruding portion having a slit that extends diagonally from an edge of the protruding portion outward in the crossing direction and upstream in the movement direction, the edge facing inward in the crossing direction.

BRIEF DESCRIPTION OF THE DRAWINGS

Exemplary embodiments of the present invention will be described in detail based on the following figures, wherein.

DETAILED DESCRIPTION

Exemplary embodiments of a removal device and an image forming apparatus according to exemplary embodiments of the present invention will be described with reference to the drawings.

Structure of Image Forming Apparatus

Figure 1:
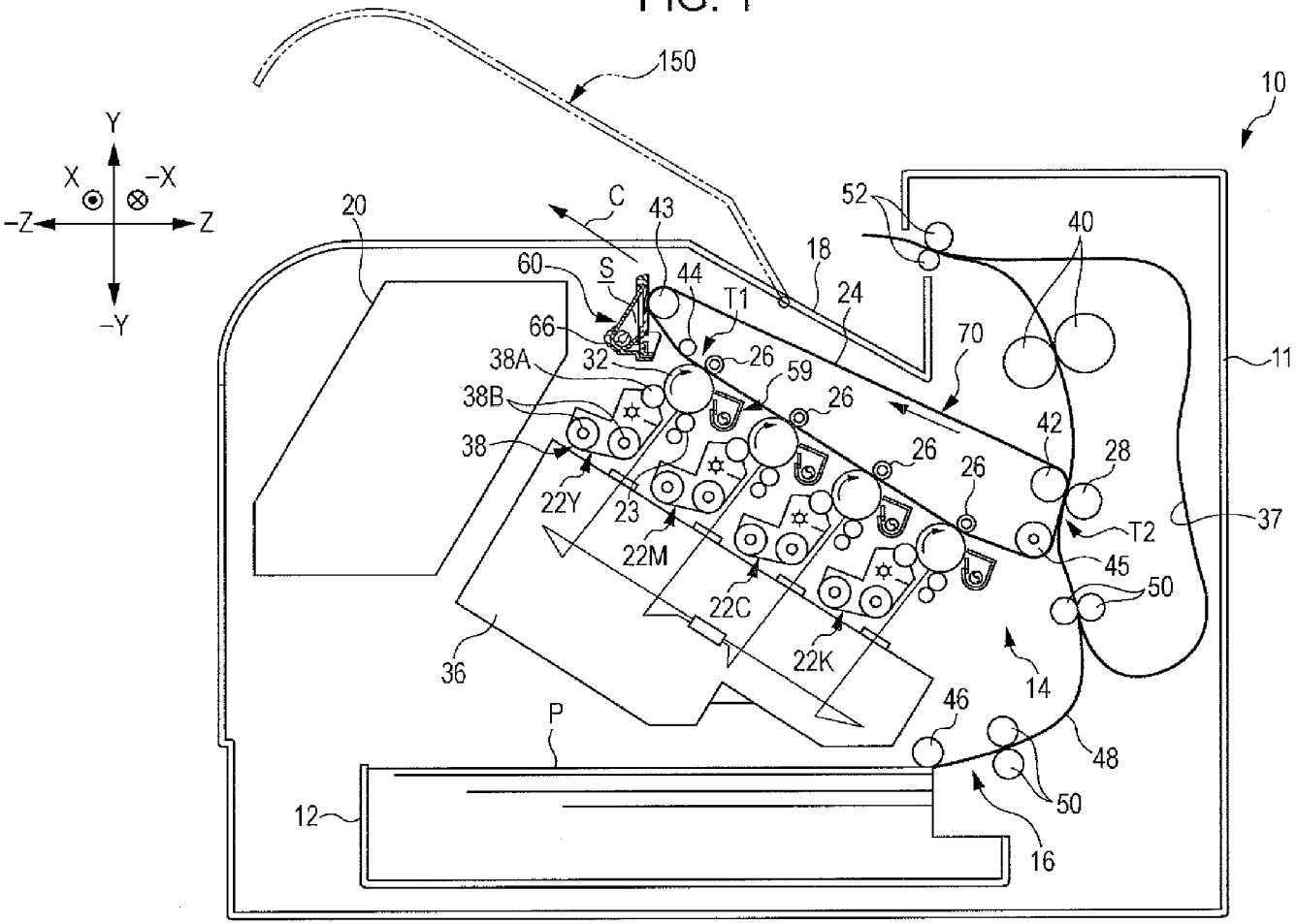
FIG. 1 illustrates an image forming apparatus according to a first exemplary embodiment of the present invention.

FIG. 1 illustrates an image forming apparatus 10 according to a first exemplary embodiment of the present invention.

In the description below, the following directions, which are indicated by arrows in the figures, will be used: X direction, −X direction, Y direction (upward), −Y direction (downward), Z direction, and −Z direction. In each figure, a symbol "O" with "×" in it represents an arrow pointing from the front side toward the back side of the plane of the figure, and a symbol "O" with "." in it represents an arrow pointing from the back side toward the front side of the plane of the figure.

The image forming apparatus 10 illustrated in FIG. 1 may be used as a printer, a facsimile machine, a copier, a multifunctional machine, or the like. The use of the image forming apparatus 10 is not particularly limited.

First, the structure of the image forming apparatus 10 according to the present exemplary embodiment will be described.

The image forming apparatus 10 includes an image forming apparatus body 11, in which a tray 12, an image forming section 14, a transport unit 16, a controller 20, and other components of the image forming apparatus 10 are disposed. The tray 12 holds a recording medium P, such as a sheet. The image forming section 14 forms an image on the recording medium P. The transport unit 16 transports the recording medium P from the tray 12 to the image forming section 14. The controller 20 controls operations of various parts of the image forming apparatus 10. Moreover, an output section 18 is disposed on an upper part of the image forming apparatus body 11. The recording medium P, on which the image forming section 14 has formed an image, is output to the output section 18.

The image forming section 14 includes image forming units 22Y, 22M, 22C, and 22K (hereinafter, referred to as the image forming units 22Y to 22K); a transfer unit 70; and a second-transfer roller 28. The image forming units 22Y to 22K respectively form yellow (Y), magenta (M), cyan (C), and black (K) toner images. The transfer unit 70 includes an intermediate transfer belt 24, to which the toner images formed by the image forming units 22Y to 22K are transferred. The second-transfer roller 28 transfers the toner images, which have been transferred to the intermediate transfer belt 24, from the intermediate transfer belt 24 to the recording medium P. Each of the image forming units 22Y to 22K is an example of an image forming unit according to the present invention. The intermediate transfer belt 24 is an example of an image carrier and also is an example of a cleaning object according to the present invention.

The image forming units 22Y to 22K are arranged in the image forming apparatus body 11 in a direction inclined with respect to the horizontal direction (Z direction). Each of the image forming units 22Y to 22K includes a photoconductor 32 that rotates in one direction (for example, the clockwise direction in FIG. 1). In FIG. 1, numerals are attached to the components of only the image forming unit 22Y (yellow), because the image forming units 22Y to 22K have the same structure.

Around each of the photoconductors 32, a charging roller 23, a developing device 38, and a removal device 59 are arranged in this order in the direction in which the photoconductor 32 rotates. The charging roller 23 charges the photoconductor 32. An exposure device 36 (described below) forms an electrostatic latent image on the charged photoconductor 32 by exposing the photoconductor 32 to light. The developing device 38 forms a toner image by developing the electrostatic latent image. The removal device 59 removes remaining toner remaining on the photoconductor 32.

The exposure device 36 is disposed diagonally below the image forming units 22Y to 22K. The exposure device 36 forms electrostatic latent images on the photoconductors 32, which have been charged by the charging rollers 23, by exposing the photoconductors 32 to light. The exposure device 36 forms the electrostatic latent images on the basis of an image signal sent from the controller 20. Examples of an image signal sent from the controller 20 include an image signal that the controller 20 has received from an external apparatus.

The developing device 38 includes a developer supplying member 38A and plural transport members 38B. The developer supplying member 38A supplies a developer to the photoconductor 32. The transport members 38B transport the developer, to be supplied to the developer supplying member 38A, while agitating the developer.

The transfer unit 70 is disposed diagonally above the image forming units 22Y to 22K. The transfer unit 70 may be pulled out of the image forming apparatus body 11 in the direction of arrow C in FIG. 1 when a cover 150, which is disposed in an upper part of the image forming apparatus body 11, is open.

The transfer unit 70 includes plural (in the present exemplary embodiment, four) first-transfer rollers 26, which are disposed on the inner periphery of the intermediate transfer belt 24. The first-transfer rollers 26 transfer toner images, which have been formed by the image forming units 22Y to 22K, to the intermediate transfer belt 24. Each of the first-transfer rollers 26 faces a corresponding one of the photoconductors 32 with the intermediate transfer belt 24 therebetween. A position between the first-transfer roller 26 and the photoconductor 32 is a first-transfer position T1, at which a toner image formed on the photoconductor 32 is transferred to the intermediate transfer belt 24.

The transfer unit 70 includes a driving roller 43, a tension roller 45, a counter roller 42, and a support roller 44. The intermediate transfer belt 24 is looped over these rollers. The driving roller 43 rotates the intermediate transfer belt 24. The tension roller 45 applies a tension to the intermediate transfer belt 24. The counter roller 42 faces the second-transfer roller 28 with the intermediate transfer belt 24 therebetween. A position between the second-transfer roller 28 and the counter roller 42 is a second-transfer position T2, at which a toner image, which has been transferred to the intermediate transfer belt 24, is transferred to the recording medium P.

A removal device 60 is disposed diagonally above the transfer unit 70. The removal device 60 removes waste from the intermediate transfer belt 24. Examples of waste include remaining toner remaining on the intermediate transfer belt 24 after toner images have been transferred to the recording medium P, paper dust, and corona by-products. The removal device 60 is a removal device according to a first exemplary embodiment of the present invention. The detailed structure of the removal device 60 will be described below.

The transport unit 16 includes a feed roller 46, a transport path 48, and plural transport rollers 50. The feed roller 46 feeds a recording medium P from the tray 12. The recording medium P, which has been fed by the feed roller 46, is transported along the transport path 48. The transport rollers 50 transport the recording medium P, which has been fed by the feed roller 46 along the transport path 48, to the second-transfer position T2.

A fixing unit 40 is disposed downstream from the second-transfer position T2 in the transport direction. The fixing unit 40 fixes the toner image, which has been formed on the recording medium P by the image forming section 14, to the recording medium P. Output rollers 52 are disposed downstream of the fixing unit 40. The output rollers 52 output the recording medium P, to which the toner image has been fixed, to the output section 18.

A reverse transport path 37 is disposed on a side of the transport path 48 opposite to the transfer unit 70 side (in Z direction from the transport path 48). The reverse transport path 37 enables the recording medium P, on one side of which a toner image has been fixed, to be transported back to the second-transfer position T2. When forming toner images on both sides of a recording medium P, after a toner image has been fixed to one side of the recording medium P, the output rollers 52 transport the recording medium P back to the second-transfer position T2 along the reverse transport path 37.

Image Forming Operation

Next, an image forming operation, which is performed by the image forming apparatus 10 illustrated in FIG. 1 to form an image on a recording medium P, will be described.

When the image forming apparatus 10 starts the image forming operation, the feed roller 46 feeds a recording medium P from the tray 12, and the transport rollers 50 feed the recording medium P to the second-transfer position T2.

The controller 20 sends an image signal to the exposure device 36, the charging rollers 23 of the image forming units 22Y to 22K charge the photoconductors 32, and the exposure device 36 exposes the photoconductors 32 with light, thereby forming electrostatic latent images on the photoconductors 32. The developing devices 38 develop the electrostatic latent images to form color toner images on the photoconductors 32. The color toner images, which have been formed by the image forming units 22Y to 22K, are transferred to the intermediate transfer belt 24 at the first-transfer positions T1 so as to overlap each other, thereby forming a color image. The color image, which has been formed on the intermediate transfer belt 24, is transferred to the recording medium P at the second-transfer position T2.

The recording medium P, to which the toner image has been transferred, is transported to the fixing unit 40, and the fixing unit 40 fixes the toner image to the recording medium P. When forming an image on only one side of the recording medium P, the output rollers 52 output the recording medium P, to which the toner image has been fixed, to the output section 18. When forming images on both sides of the recording medium P, after an image has been formed on one side of the recording medium P, the output rollers 52 feed the recording medium P back to the reverse transport path 37. The recording medium P is fed from the reverse transport path 37 to the second-transfer position T2 again, and an image is formed on the other side of the recording medium P, on which an image has not been formed, in the same way as described above. When images have been formed on both sides of the recording medium P, the output rollers 52 output the recording medium P to the output section 18. The image forming operation is performed through the steps described above.

Transfer Unit

Next, the structure of the transfer unit 70 will be described.

Figure 2:
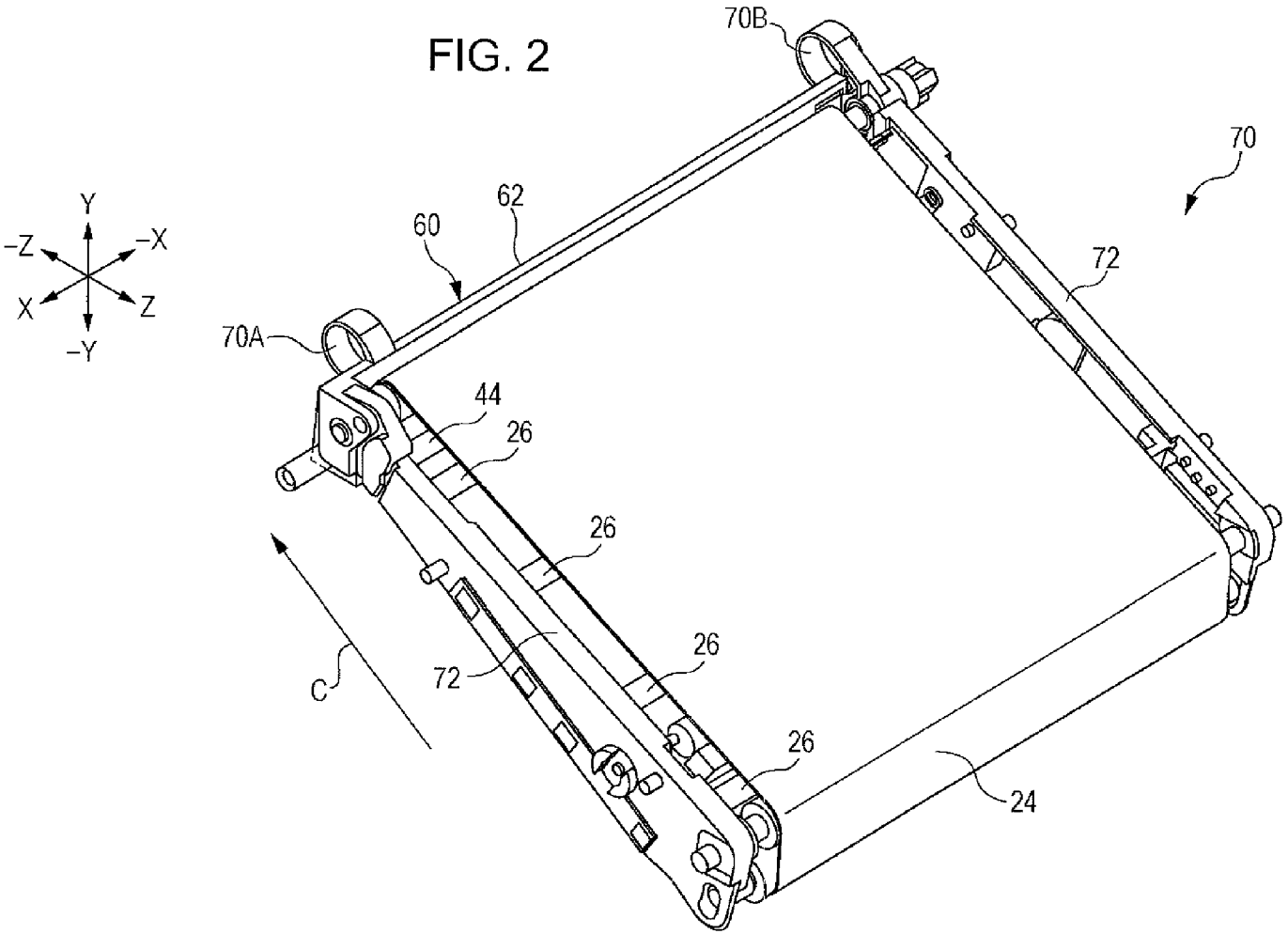
FIG. 2 is a perspective view of a transfer unit.

FIG. 2 is a perspective view of the transfer unit 70.

The transfer unit 70 includes a pair of frame members 72. The pair of frame members 72 each have a shape elongated in a direction in which the transfer unit 70 is pulled out (direction of arrow C).

One of the frame members 72 in −X direction has a handle 70B at an end thereof in the longitudinal direction. An operator holds the handle 70B when pulling out the transfer unit 70. The removal device 60 has a handle 70A, which is paired with the handle 70B, at an end thereof in X direction.

As illustrated in FIG. 2, the intermediate transfer belt 24 is disposed between the pair of frame members 72.

The driving roller 43 is rotatably supported by the pair of frame members 72. The intermediate transfer belt 24 is rotated by the driving roller 43. The counter roller 42 and the support roller 44, which are rotatably supported by the pair of frame members 72, are rotated by the intermediate transfer belt 24.

Removal Device

Next, the removal device 60, which removes waste from the intermediate transfer belt 24, will be described.

Figure 3:
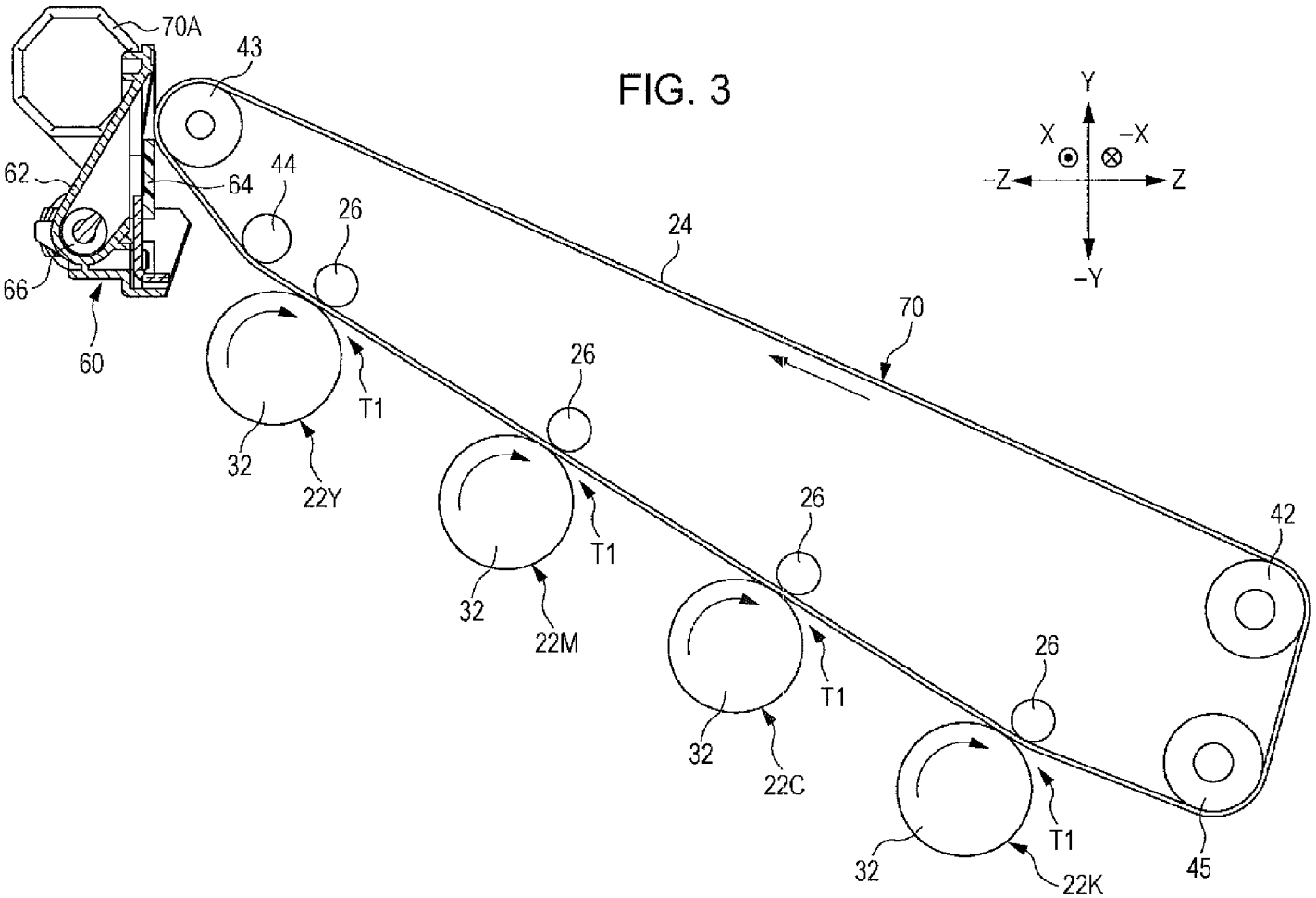
FIG. 3 illustrates the positional relationship between a removal device and transfer units.
Figure 4:
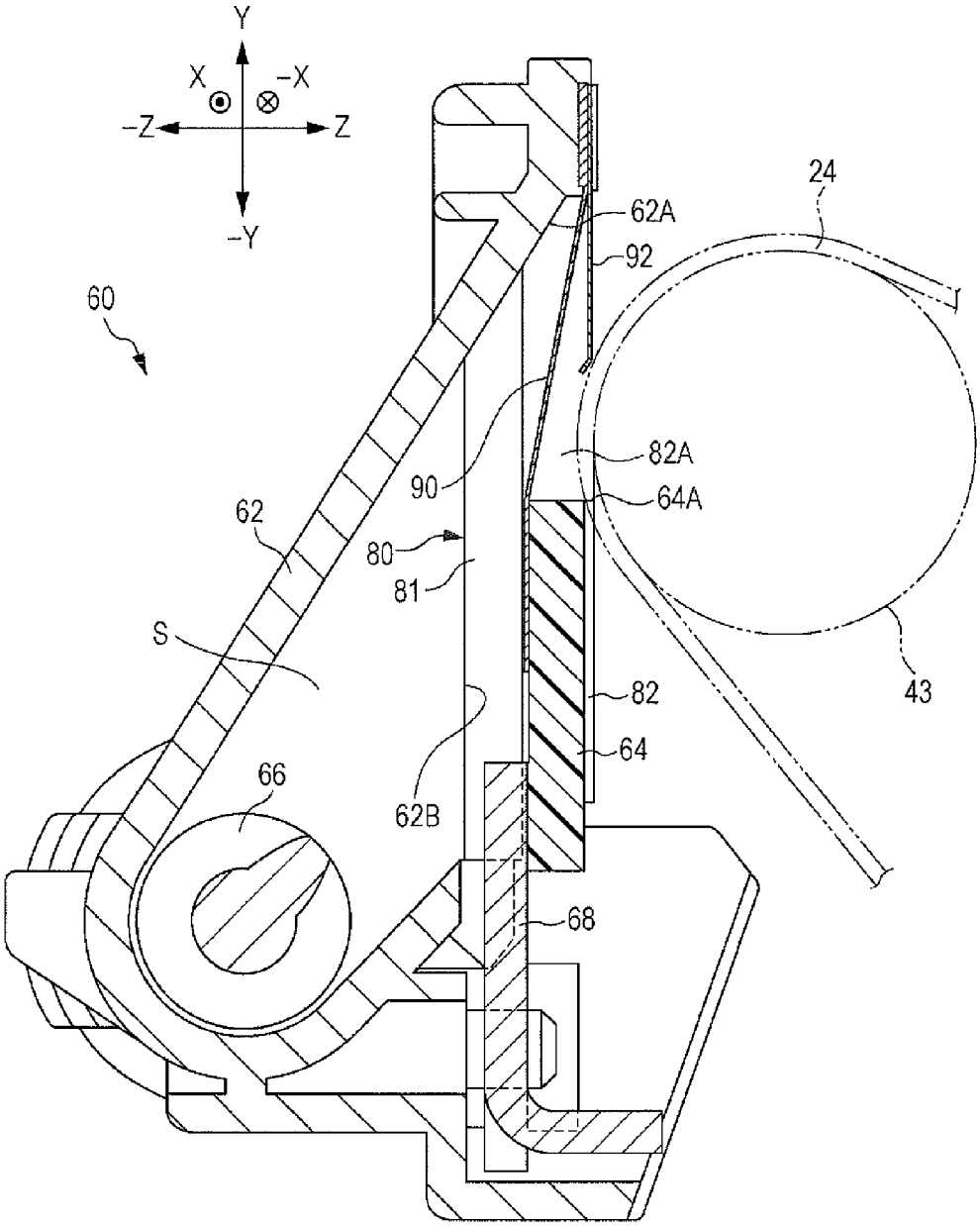
FIG. 4 illustrates the structure of the removal device.

FIG. 3 illustrates the positional relationship between the removal device 60 and the transfer unit 70. FIG. 4 illustrates the structure of the removal device 60.

As illustrated in FIG. 3, the removal device 60 is disposed in contact with an outer periphery of the intermediate transfer belt 24. The removal device 60 is disposed so as to face the driving roller 43 with the intermediate transfer belt 24 therebetween.

The removal device 60 includes a blade 64 and a housing 62. The blade 64 is rectangular-parallelepiped-shaped (plate-shaped) and is made of rubber (such as polyurethane rubber, natural rubber, isoprene rubber, chloroprene rubber), which is an example of an elastic material. The blade 64 is an example of a scraping member according to the present invention. As illustrated in FIG. 4, an edge 64A (corner) of the blade 64 is in contact with a surface of the intermediate transfer belt 24, which rotates. The edge 64A is an example of a contact portion according to the present invention. In the present exemplary embodiment, the edge 64A scrapes the waste, such as remaining toner, off the surface of the intermediate transfer belt 24.

The housing 62 of the removal device 60 has an opening 62A that faces the intermediate transfer belt 24. The housing 62 has a container space S for containing waste removed by the blade 64. A transport member 66 is disposed in the container space S of the housing 62. The transport member 66 transports waste from the container space S to a container vessel (not shown) in a direction perpendicular to the plane of FIG. 4.

A support member 68, which supports the blade 64, is attached to the housing 62. The support member 68 is L-shaped as seen in a direction (−X direction) along the axis of the driving roller 43. The support member 68 is made from, for example, a metal plate.

A surface, facing in −Z direction, of an end portion of the blade 64 in −Y direction (lower end portion) is fixed to a surface, facing in Z direction, of an end portion of the support member 68 in Y direction (upper end portion). Thus, the blade 64 is disposed between the opening 62A of the housing 62 and the intermediate transfer belt 24 in such a way that the edge 64A, which is at an end of the blade 64 in Y direction (upper end), is pressed against the intermediate transfer belt 24. When the intermediate transfer belt 24 rotates while the edge 64A of the blade 64 is pressed against a surface of the intermediate transfer belt 24, the edge 64A scrapes waste off the surface of the intermediate transfer belt 24. The waste, scraped off by the blade 64, drops into the container space S in the housing 62 by gravity or the like. In the following description, the term "remaining toner" will be used instead of "waste", because most of the waste that is actually scraped off by the blade 64 is remaining toner.

A blocking film 90 and a suppression film 92 are attached to an upper part of the housing 62. The blocking film 90 blocks movement of remaining toner, which has been scraped off by the blade 64, beyond the edge 64A of the blade 64. The suppression film 92 suppresses upward leakage of the remaining toner, which has been stopped by the blocking film 90. The blocking film 90 and the suppression film 92 are each made from, for example, a flexible resin film, such as a PET film.

A lower end portion (end portion in −Y direction) of the blocking film 90 is in contact with a back surface of the blade 64 (surface facing in −Z direction) in an unfixed state. Because the blocking film 90 blocks movement of remaining toner at the edge 64A of the blade 64, a toner deposit, which is in contact with the edge 64A of the blade 64 and the intermediate transfer belt 24, is formed. A part of the remaining toner that is blocked by the blocking film 90 at a position relatively farther from the edge 64A in −Z direction is pushed by remaining toner that is additionally scraped off by the blade 64. Thus, the part of the remaining toner passes through a space between the blade 64 and the blocking film 90, and drops into the container space S. As a result, the remaining toner that is blocked by the blocking film 90 is gradually replaced with remaining toner that is additionally scraped off by the blade 64. The toner deposit, which is formed from the remaining toner that is blocked, serves to reduce friction between the intermediate transfer belt 24 and the blade 64 and to efficiently remove corona by-products from the intermediate transfer belt 24.

A lower end portion (end portion in −Y direction) of the suppression film 92 is in contact with a surface of the intermediate transfer belt 24 in an unfixed state. The suppression film 92 suppresses upward leakage of remaining toner in the toner deposit through a space between the housing 62 and the intermediate transfer belt 24.

Figure 5:
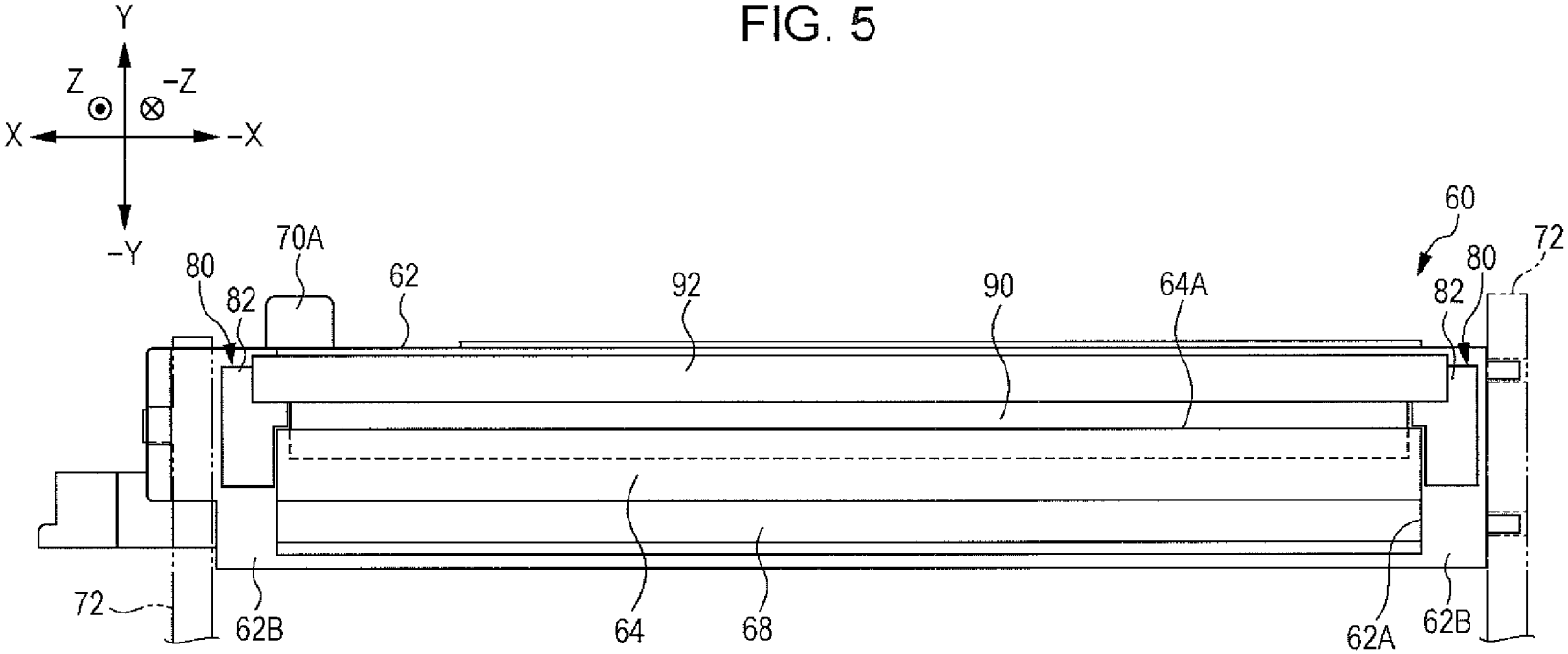
FIG. 5 illustrates the removal device as seen from the driving roller side.

FIG. 5 illustrates the removal device 60 as seen from the driving roller 43 side.

As illustrated in FIG. 5, the housing 62, the blade 64, the support member 68, the blocking film 90, and the suppression film 92 have rectangular shapes that are elongated in X direction. The X direction is a direction that crosses a movement direction in which the intermediate transfer belt 24, which is an example of a cleaning object, moves (here, for example, the horizontal direction). Therefore, a toner deposit, which is formed from remaining toner scraped off by the blade 64 and blocked by the blocking film 90, is formed so as to extend linearly along the edge 64A of the blade 64.

The housing 62 has facing surfaces 62B, which face the intermediate transfer belt 24, at both ends of the opening 62A in the longitudinal direction. Sealing members 80 are attached to the facing surfaces 62B. The sealing members 80 seal spaces between the facing surfaces 62B and the intermediate transfer belt 24 on both outer sides of the blade 64 in the longitudinal direction (the direction that crosses the movement direction of the intermediate transfer belt 24). The sealing members 80 are examples of a sealing member according to the present invention. The sealing members 80 suppress sideways leakage of remaining toner in a toner deposit, which has been formed linearly along the edge 64A, through a space between the housing 62 and the intermediate transfer belt 24 (in X direction and −X direction).

Sealing Member

Figure 6:
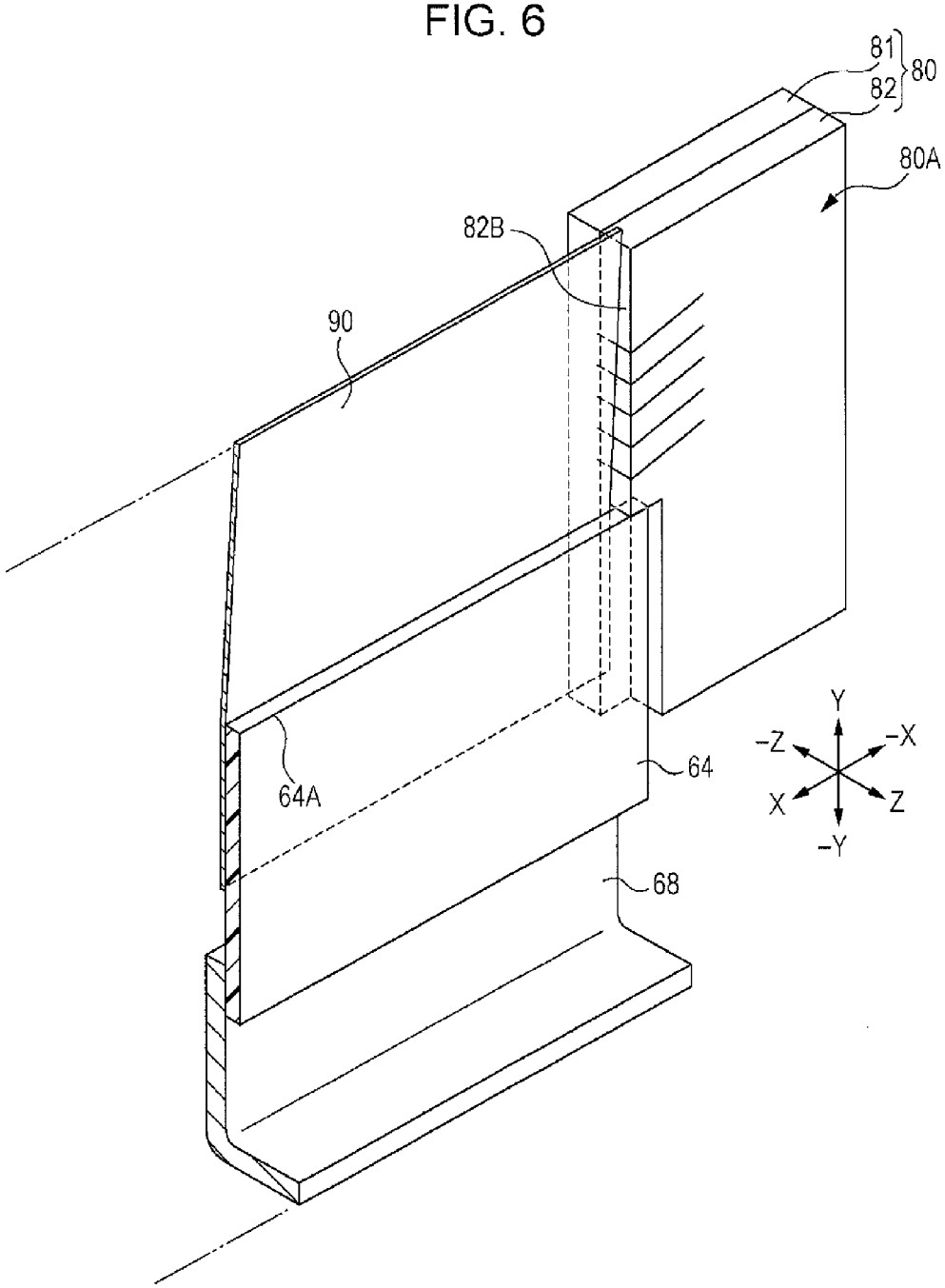
FIG. 6 is a perspective view illustrating the detailed structure of a sealing member.
Figure 7:
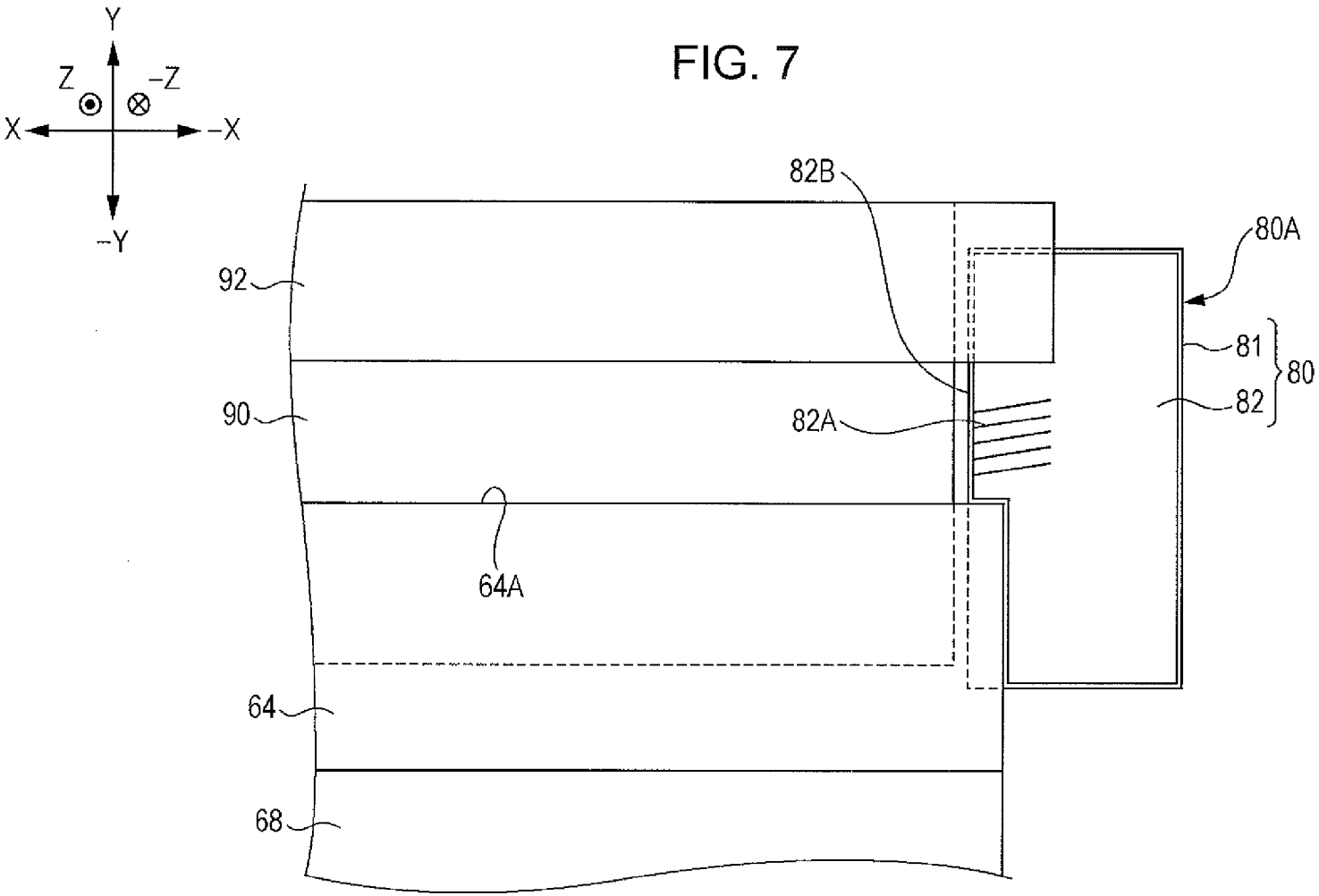
FIG. 7 illustrates a region surrounding the sealing member as seen from the driving roller side.

FIG. 6 is a perspective view illustrating the detailed structure of one of the sealing members 80. FIG. 7 illustrates a region surrounding the sealing member 80 as seen from the driving roller 43 side.

FIGS. 6 and 7 illustrate one of the sealing members 80 at one end of the blade 64 in −X direction. The other sealing member 80, at the other end of the blade 64 in X direction, has a structure similar to (specifically, symmetrical with respect to YZ plane to) the structure shown in FIGS. 6 and 7.

In the present exemplary embodiment, the sealing member 80 has a double layer structure including a first layer, which is a base seal 81 attached to the facing surface 62B, and a second layer, which is a side seal 82 attached to a surface of the base seal 81.

The side seal 82 is disposed on each of outer sides of the blade 64 (at one end in −X direction in FIGS. 6 and 7 and at the other end in X direction). As illustrated in FIG. 4, the side seal 82 overlaps the blade 64 in a side view (seen in X direction).

The sealing member 80 includes a protruding portion 80A, which protrudes beyond the edge 64A of the blade 64 upstream in the movement direction of the intermediate transfer belt 24 (Y direction). The side seal 82 in the protruding portion 80A protrudes toward the blade 64 (in X direction). The side seal 82 in the protruding portion 80A has plural slits 82A. The slits 82A extend diagonally outward (in −X direction) from an edge 82B, which faces inward in the crossing direction (in X direction), and upstream in the movement direction of the intermediate transfer belt 24 (in Y direction). A small amount of remaining toner (waste) that has entered a space between the sealing member 80 and the intermediate transfer belt 24 (that is, between the side seal 82 and the intermediate transfer belt 24) is guided along the slits 82A, extending diagonally as described above, toward the inside of the housing 62 due to a frictional force generated as the intermediate transfer belt 24 moves. As a result, leakage of remaining toner (waste) on both outer sides of the blade 64 is suppressed. In order to efficiently suppress such leakage, it is desirable that the entirety of each slit 82A extend diagonally from an end portion of the slit 82A (that is, an end portion at the edge 82B) with respect to the movement direction of the intermediate transfer belt 24.

Second Exemplary Embodiment

Next, a second exemplary embodiment of the present invention will be described. The second exemplary embodiment is the same as the first exemplary embodiment, except that the shape of a sealing member differs from that of the first exemplary embodiment. The following description will be focused on the shape of the sealing member, while omitting redundant description.

Figure 8:
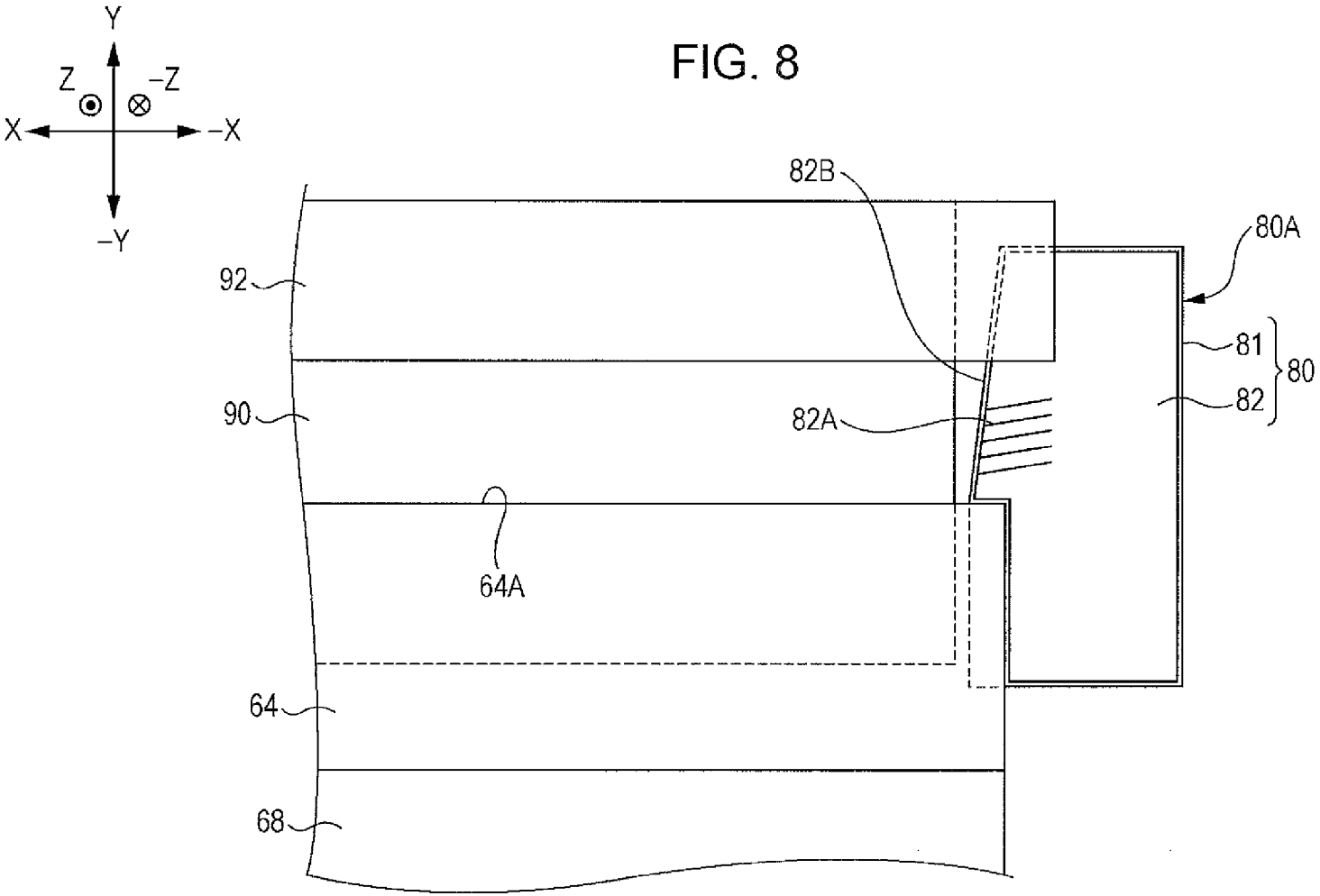
FIG. 8 illustrates the shape of a sealing member according to a second exemplary embodiment.

FIG. 8 illustrates the shape of one of sealing members 80 according to the second exemplary embodiment.

FIG. 8 illustrates one of the sealing members 80 located at one end of the blade 64 in −X direction, as FIG. 7 does. The other sealing member 80, which is located at the other end of the blade 64 in X direction, has a structure similar to (symmetrical with respect to YZ plane to) the structure shown in FIG. 8.

In the second exemplary embodiment, in a protruding portion 80A, an edge 82B, which faces inward in the crossing direction (in X direction), extends diagonally outward in the crossing direction (in −X direction) and upstream in the movement direction of the intermediate transfer belt 24. With such a structure, in which the edge 82B extends diagonally outward, remaining toner (waste) forming a toner deposit is guided toward the inside of the housing 62 (in X direction). Therefore, the amount of remaining toner (waste) is reduced that enters a space between the sealing member 80 and the intermediate transfer belt 24 (that is, a space between the side seal 82 and the intermediate transfer belt 24) as described above. As a result, leakage of remaining toner (waste) is further suppressed due to the function of the edge 82B, extending diagonally outward, as well as the function of the slits 82A described above.

Heretofore, exemplary embodiments have been described.

In the above description, the intermediate transfer belt 24 is used as an example of an image carrier, and the removal device 60, which removes waste from the intermediate transfer belt, is used as an example of a removal device according to the present invention. However, an image carrier according to the present invention may be the photoconductor 32; and a removal device according to the present invention may be the removal device 59, which removes waste from the photoconductor 32. In this case, a combination of the charging roller 23, the exposure device 36, and the developing device 38 corresponds to an image forming unit according to the present invention.

In the above description, a so-called tandem-type color image forming apparatus is used as an example of an image forming apparatus according to the present invention. However, an image forming apparatus according to the present invention may be a so-called revolver-type color image forming apparatus or a monochrome image forming apparatus.

In the above description, the sealing member 80, having a double layer structure, is used as an example of a sealing member according to the present invention. However, a sealing member according to the present invention may have a single layer structure or a structure having three or more layer.

In the above description, the protruding portion 80A, which protrudes toward the blade, is used as an example of a sealing member according to the present invention. However, a sealing member according to the present invention need not protrude toward the blade and it is only necessary that the sealing member be located on an outer side of the blade.

In the above description, the slits 82A, which are linear, are used as examples of a slit according to the present invention. However, a slit in a sealing member according to the present invention may be a curved slit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A removal device comprising:

a scraping member extending in a crossing direction that crosses a movement direction in which a cleaning object moves, the scraping member scraping waste off a surface of the cleaning object at a contact portion of the scraping member that is in contact with the surface; and a pair of sealing members disposed on both outer sides of the scraping member in the crossing direction and sealing the both outer sides by contacting the surface, each of the sealing members including a protruding portion that protrudes beyond the contact portion upstream in the movement direction of the cleaning object, the protruding portion comprising a slit that extends diagonally on the surface from an edge of the protruding portion outward in the crossing direction and upstream in the movement direction, the edge facing inward in the crossing direction.

2. The removal device according to claim 1, wherein the edge of the protruding portion of each of the sealing members, the edge facing inward in the crossing direction, extends diagonally outward in the crossing direction and upstream in the movement direction.

3. An image forming apparatus comprising:

an image carrier that rotates and carries an image on a surface thereof;

an image forming unit that forms an image on the surface of the image carrier;

a scraping member extending in a crossing direction that crosses a movement direction in which the image carrier moves, the scraping member scraping waste off the surface of the image carrier at a contact portion of the scraping member that is in contact with the surface; and a pair of sealing members disposed on both outer sides of the scraping member in the crossing direction and sealing the both outer sides by contacting the surface, each of the sealing members including a protruding portion that protrudes beyond the contact portion upstream in the movement direction of the image carrier, the protruding portion comprising a slit that extends diagonally on the surface from an edge of the protruding portion outward in the crossing direction and upstream in the movement direction, the edge facing inward in the crossing direction.

* * * * *